US005669860A

United States Patent [19]

Reyes

[11] Patent Number: 5,669,860

[45] Date of Patent: Sep. 23, 1997

[54] DEVICE FOR EXERCISING THE LOWER BACK

[75] Inventor: Gilbert Reyes, Las Vegas, Nev.

[73] Assignee: Reyes Equipment, Inc., Las Vegas, Nev.

[21] Appl. No.: 367,086

[22] Filed: Dec. 30, 1994

[51] Int. Cl.[6] ..... A63B 21/08; A63B 23/02

[52] U.S. Cl. ..... 482/97; 482/95; 482/137; 482/142; 482/145

[58] Field of Search ..... 482/92–98, 104–106, 482/133–140, 142, 144, 145, 148, 137, 100

[56] References Cited

U.S. PATENT DOCUMENTS

| | | | |
|---|---|---|---|
| 3,235,255 | 2/1966 | Leflar | 482/104 |
| 4,182,511 | 1/1980 | Camp, Jr. | 482/145 |
| 4,319,747 | 3/1982 | Rogers | 482/145 |
| 4,387,894 | 6/1983 | Baumann | 482/139 |
| 4,391,443 | 7/1983 | Beecroft | 482/145 |
| 4,564,193 | 1/1986 | Stewart | 482/102 |
| 4,662,631 | 5/1987 | Seal . | |
| 4,729,562 | 3/1988 | Pipasik | 482/97 |
| 4,883,270 | 11/1989 | Maag | 482/137 |
| 5,094,450 | 3/1992 | Stearns | 482/130 |
| 5,106,083 | 4/1992 | Hall | 482/145 |
| 5,250,013 | 10/1993 | Brangi | 482/98 |
| 5,356,359 | 10/1994 | Simmons | 482/137 |

FOREIGN PATENT DOCUMENTS

| | | | |
|---|---|---|---|
| 2613631 | 4/1987 | France . | |
| 9004839 | 7/1990 | Germany . | |
| 1245323 A1 | 7/1986 | U.S.S.R. | 482/100 |

OTHER PUBLICATIONS

Atlantic Fitness Products catalog, Roman Exercise Bench #1248, p. 23. 1985.

Holbrook, Tom, Magazine Article Specialization in the Magazine Strength & Health, Dec. 1971, p. 41.

Body Masters Sports Industry Inc., Advertisement in 1979 "Mr. America" Program.

*Primary Examiner*—Richard J. Apley
*Assistant Examiner*—Victor K. Hwang
*Attorney, Agent, or Firm*—Knobbe, Martens, Olson & Bear

[57] ABSTRACT

An exercise device for use by an exerciser in exercising his back muscles includes a frame, waist support, leg stop, and weight carriage. The frame comprises a ground contacting base and front and rear frame members. The waist support is located on top of the front frame member and the leg stop is located on the bottom of the rear frame member. The weight carriage is rotatably mounted to the frame, and includes a carriage frame, weight supporting bars, and a handle. The carriage is movable between a first resting position in which it extends downwardly from the front frame member to a second extended position in which it extends generally horizontally out from the front frame member.

12 Claims, 4 Drawing Sheets

DEVICE FOR EXERCISING THE LOWER BACK

FIELD OF THE INVENTION

The present invention relates to an exercise machine, especially for lower back muscles.

BACKGROUND OF THE INVENTION

Many people who engage in regular exercise routines fail to recognize the importance of properly exercising the back muscles. Strength of the back muscles is important because they are used in almost every exercise and day-to-day activity.

An exerciser makes significant use of back muscles in, for example, exercises ranging from push-ups to running to military bar-bell weight presses. Further, every individual makes substantial use of his back muscles every day, whether at work or at play. The most commonly recognized use of the back muscles occurs when an individual bends over and picks up an item. Unfortunately, weak back muscles often result in a back injury. Healthy individuals could avoid such injuries not only by engaging in the activity in the proper manner, but by strengthening the back muscles.

Notwithstanding the fact that healthy individuals often neglect their backs, those who have injured their backs require a safe and effective way of strengthening their backs in order to regain the strength necessary to engage in day-to-day activities. Therapists and doctors recommend numerous procedures and products strengthening these muscles.

One exercise involves the use of a padded rail which is located some distance above the floor. In this exercise, a user supports his body by locating his waist on the rail, and allows his torso to extend over the rail. Thus, the user's torso freely hangs out past the rail. In a relaxed position, the user's torso extends downwardly towards the floor, and in an exercise position, he pulls his torso upwardly towards a horizontal position. Because the user's torso extends freely in an open space, the user can not use his arms to maintain proper positioning of his body. In fact, the exerciser normally crosses his arms in front of his torso to keep them out of the way.

Because the user hangs freely from the rail, a tired exerciser may twist his back sideways when raising his body upwardly in an attempt to gain leverage to right his torso. This manipulation can cause injury to the back during an exercise which is supposed to strengthen it.

A user exercises his back muscles in this activity as he lifts the mass of his torso against the pull of gravity from a position in which it extends downwardly from the rail to a position in which it extends horizontally outwardly therefrom. The exercise does not allow, however, for adjustment of the resistance or weight which the user lifts. Thus, once the user has achieved the minimal strength of lifting his body up and down, further development of the back muscles is limited because higher resistance is not possible.

A few machines do allow for the adjustment of the weight or opposing exercise force. Such machines normally comprise a large hinged bar connected to a selectable weight stack or similar resistance. The user engages the bar with his chest, and bends forward to move it against the opposing force.

These machines have numerous drawbacks as well. First, the machines are complicated, and thus costly to build and repair. Second, users often do not enjoy this exercise because of its difficulty. In particular, the user presses his body against a bar without using the hands. This is an uncomfortable and somewhat awkward position. Further, these machines are not very useful in exercising the back muscles because when the user presses the bar forwardly, he tends to use his stomach muscles rather than his back muscles.

SUMMARY OF THE INVENTION

The present invention is a machine which allows an exerciser to exercise his lower back in a safe and effective manner. The machine comprises a frame, waist support, leg stop, and weight supporting carriage.

The frame includes a generally rectangular ground contacting base and front and rear frame members. The front and rear frame members are inverted "U"-shaped members rising upwardly from the base.

The waist support is a padded platform located on the top surface of the front frame member. The leg stop is a padded platform located on the bottom of the rear frame member.

A rotatable weight-supporting carriage is attached to the front frame member. The carriage comprises a carriage frame, free weight supporting bars, and a handle. The carriage frame includes two spaced struts on which are mounted the weight-supporting bars and "L"-shaped legs which support the handle.

The entire carriage is rotatably connected to a sleeve located on the front frame member. In particular, the struts are located at either end of an elongate rod which is rotatably located in the sleeve.

The handle extends between the "L"-shaped legs which extend inwardly and rearwardly from the struts on their ends opposite the rod. The weight supporting bars extend outwardly from each strut on the same end as the handle. The bars support one or more free weight plates.

In use, an exerciser positions himself between the front and rear frame members. The user bends over the waist support on the front member, centering the waist portion of his body on the support. Movement of the user to this position causes his legs to leave the ground and move upwardly until they contact the leg stop located on the bottom of the rear frame member.

Once positioned on the machine, the user bends his torso downwardly towards the ground and reaches out with his arms and grasps the handle of the carriage, which in its resting position is located below the waist support. The user straightens his torso at the waist, simultaneously raising the weight carriage. The carriage rotates upwardly in arc-like fashion as the user contracts his back muscles and raises his torso. The user then bends downwardly to the starting position to complete the exercise.

Objects, features, and advantages of the present invention over the prior art will become apparent from the detailed description of the drawings which follows, when considered with the attached figures.

DETAILED DESCRIPTION OF THE PREFERRED EMBODIMENT

Figure 1:
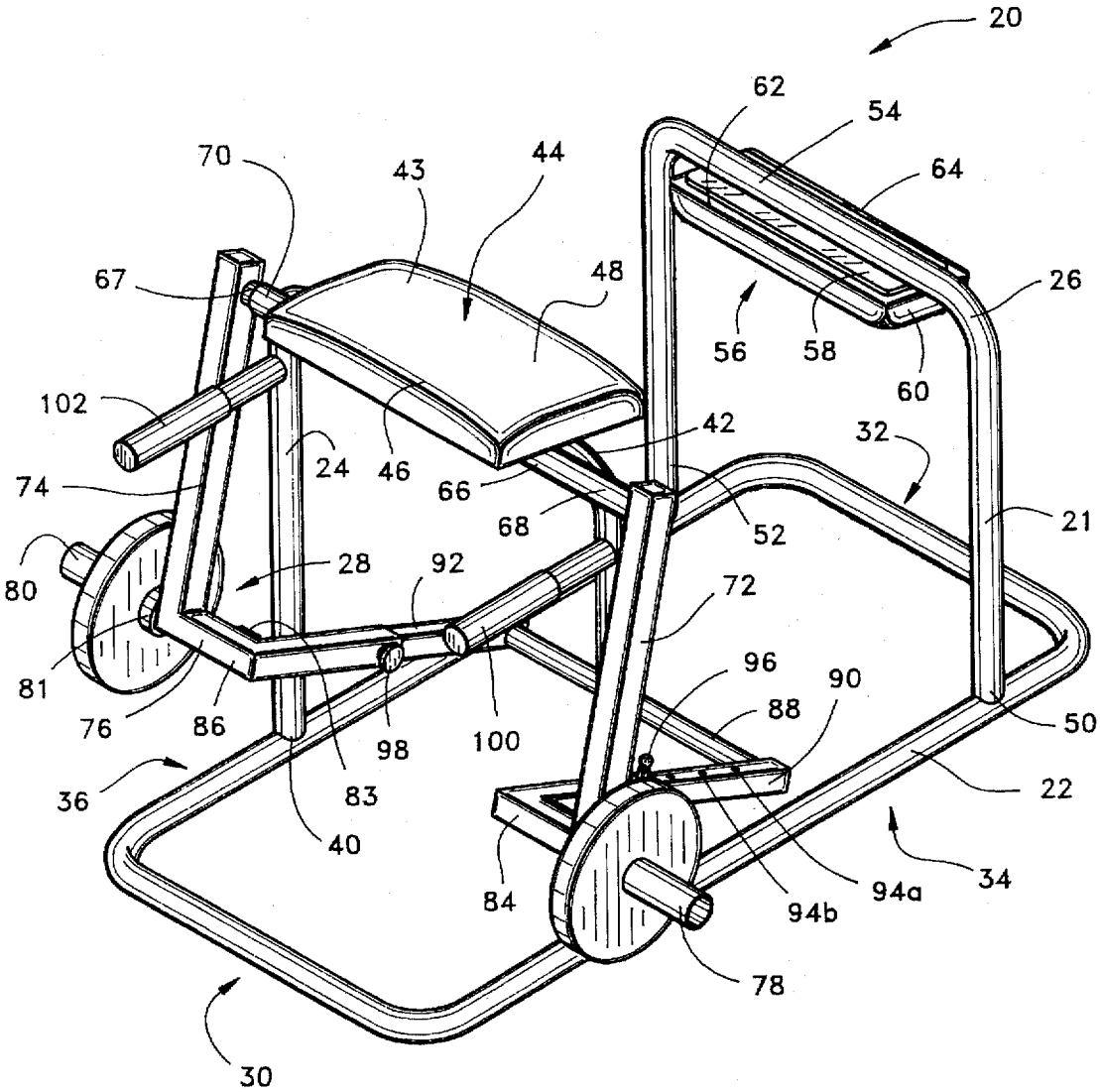
FIG. 1 is a perspective view of a back exercising device of the present invention.

As shown in FIG. 1, a back-exercising device 20 has a frame 21 which consists generally of a ground-supported base 22, an inverted, generally "U"-shaped front frame member 24, and an inverted, generally "U"-shaped rear frame member 26.

A padded waist support 44 is mounted on top of the front frame member 24, and a padded leg stop 56 is attached to the underside of the rear frame member 26 to preclude upward movement of an exerciser's legs beyond the leg stop.

Figure 2:
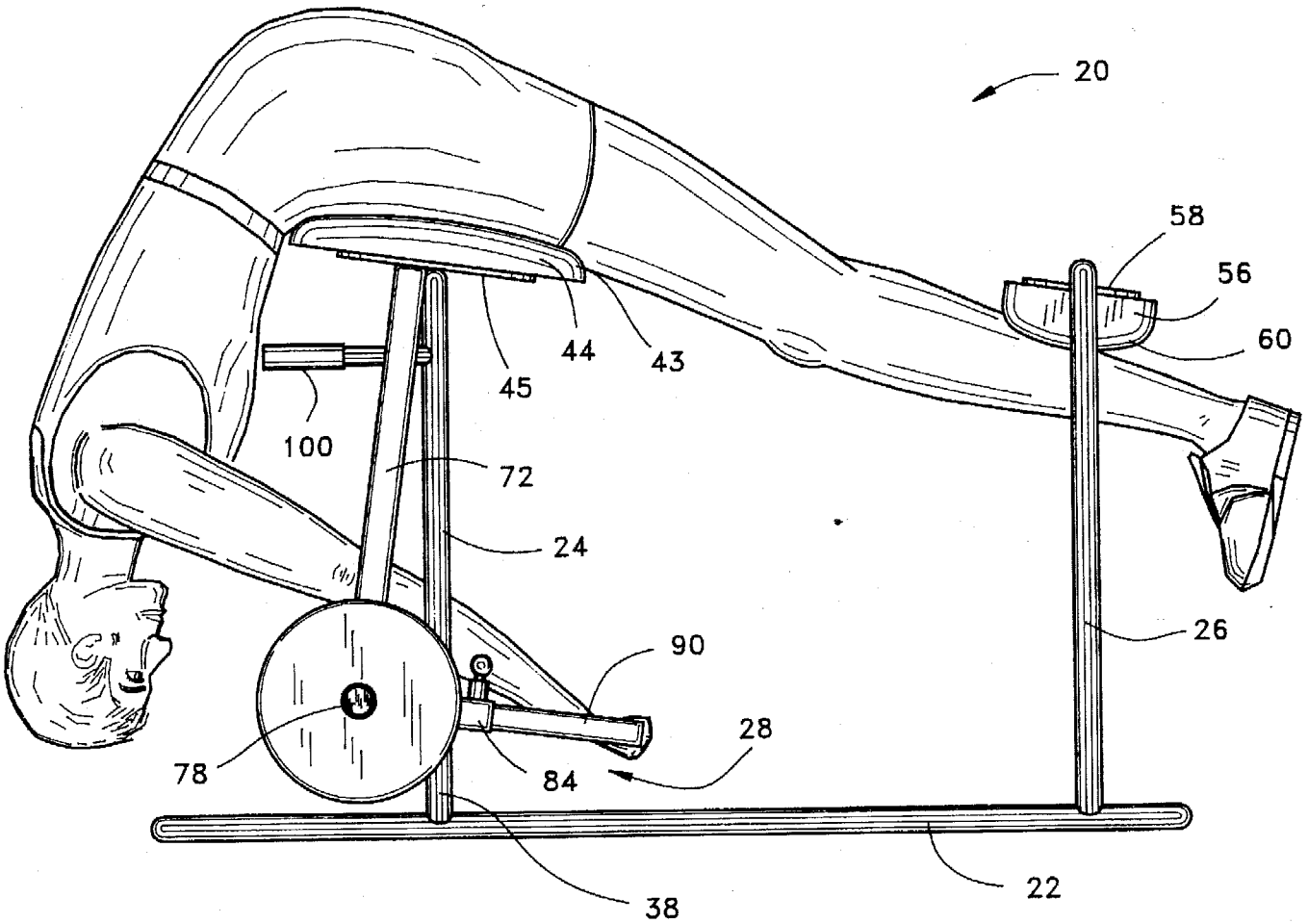
FIG. 2 is a side view of the device of FIG. 1, illustrating an exerciser in a first position.
Figure 3:
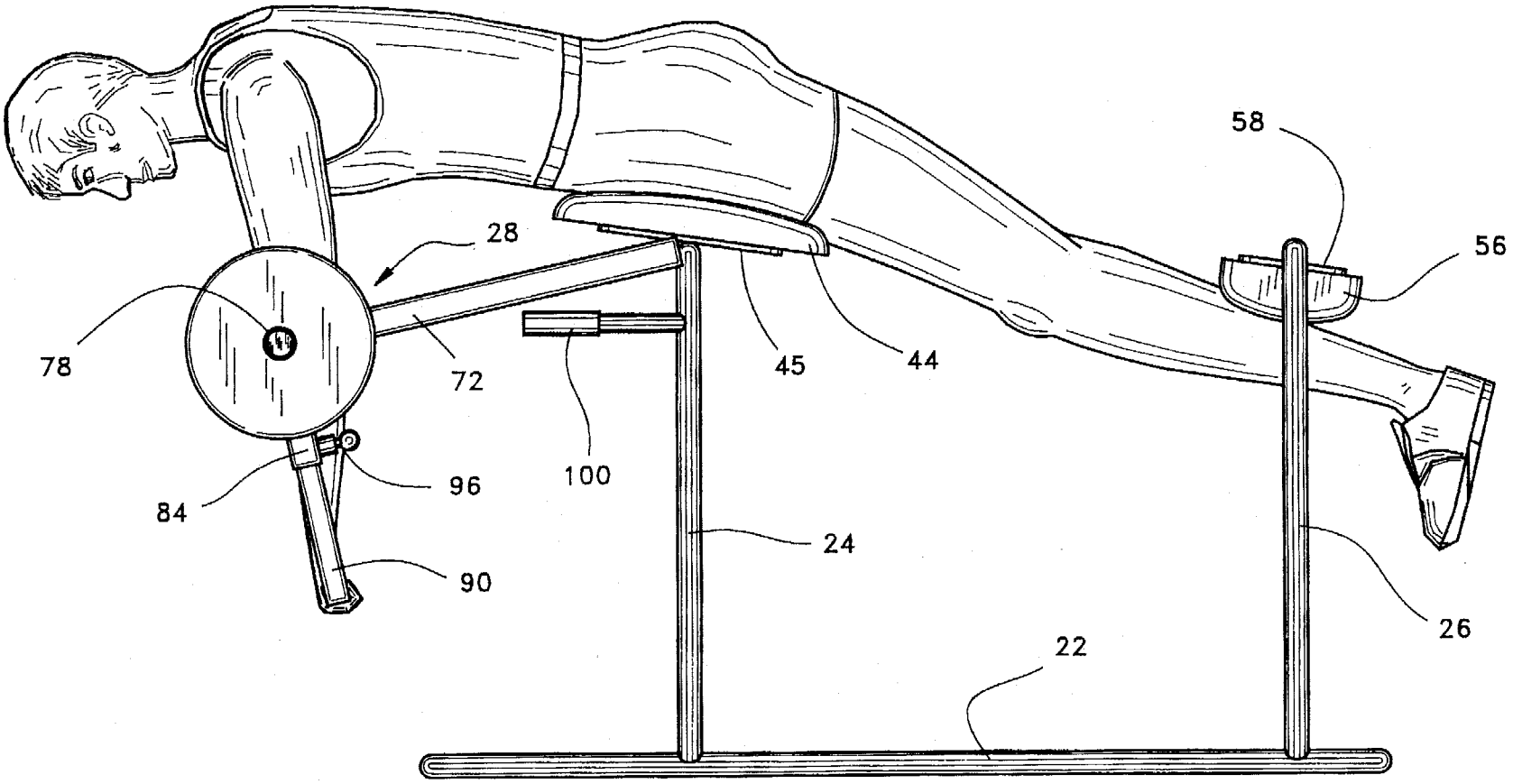
FIG. 3 is a side view of the device of FIG. 1, illustrating an exerciser in a second position.

A weight carriage 28 is pivotally mounted to the frame 21 by means of a rod 67 which rotates within an elongate sleeve 66 located on the frame. The weight carriage 28 is movable between a rest position in which the carriage hangs freely below the waist support 44 (as shown in FIGS. 1 and 2) and an extended position, as illustrated in FIG. 3.

The weight carriage 28 generally consists of the rod 67 which is pivotally connected to the sleeve 66, a carriage frame 76, opposing, outwardly extending weight-carrying bars 78,80 on which free weight discs may be placed in desired quantities, and a handle 88.

More specifically, and as best illustrated in FIG. 1, the frame 21 includes a base 22 which is generally rectangular in shape and about 45 inches in length and 24 inches in width. The base 22 has a first end portion or front 30, a second end portion or rear 32, a first side 34 and second side 36. The base 22 is made of round metal tubing approximately 2 inches in diameter with a wall thickness of about ⅛ inches. The base 22 can be made of any similar strong and durable materials, and can have a variety of shapes and sizes. The base 22 provides support to the remainder of the machine, and thus must be wide enough and long enough to be stable during use.

Referring again to FIG. 1, the frame 21 also includes a front frame member 24 which extends upwardly from the base 22 and supports a user when exercising. The front frame member 24 preferably comprises an inverted "U"-shaped member having a first end 38 (see FIG. 2), second end 40, and a center section 42. The first end 38 of the member 24 is connected to the first side 34 of the base 22 rearwardly of the front 30 by about 15 inches. The second end 40 of the member 24 is also connected to the second side 36 of the base 22 rearwardly of the front 30 by about 15 inches.

From the first and second ends 38,40 of the member 24, each leg of the "U" extends vertically upwardly to the center section 42 which extends between them. The center section 42 is about 12–28 inches, and most preferably about 21 inches long (roughly equivalent to the distance between the sides 34,36 of the base 22) and is about 26 inches above the base 22.

Preferably, the front frame member 24 is constructed of a durable, strong material such as tubular steel. A-36 tubular steel, being about 2 inches in diameter and ⅛ inches in wall thickness is desirable. When the base 22 is made of metal as well, the first and second ends 38,40 of the member 24 are welded directly to the base.

As illustrated in FIG. 1, a waist support means or waist support 44 is centered on a top portion of the central section 42 of the front frame member 24. The waist support 44 preferably comprises a rigid, flat support member 45 (seen in FIGS. 2 and 3) such as metal or wooden plate connected to the member 24 by welding, bolts or similar attachment means and a pad 43. The pad 43 comprises vinyl covered foam material located on at least a top surface of support member 45. The waist support 44 is about 21 inches wide, about 10 inches long, and about 4 inches thick.

As illustrated, the waist support 44 is tilted slightly with respect to the horizontal on the member 24 (the tilt is best seen in FIGS. 2 and 3). Preferably, the waist support 44 tilts upwardly from a rear end 48 to a front end 46 by an angle of between about 25 and 35 degrees with respect to horizontal. In other words, the waist support 44, when viewed in terms of the base 22 rises upwardly from the rear 32 to the front 30.

The rear frame member 26 has the same shape and dimensions as the first frame member 24, except that it is preferably slightly taller, at about 29 inches in height. A first end 50 and a second end 52 thereof are attached to the first side 34 and second side 36 of the base 22 respectively, about 21–22 inches towards the rear 32 of the base 22 from the front frame member 24. The exact distance between the members 24,26 can vary depending on the size of the exerciser(s) for which the device is intended.

A leg stop or leg stop means 56 is connected to a bottom surface of a center section 54 which connects the two legs of the "U"-shaped rear frame member 26. The leg stop 56 is about 16 inches wide, 6–7 inches long, and 4 inches thick. The leg stop 56 preferably comprises a metal support plate 58 directly connected to the bottom of the center section 54 of the member 26 by welding, bolts or similar attachment means. A vinyl covered foam pad 60 is located on the support plate 58.

As illustrated, while the leg stop 56 is centered on the center section 54, it is angled with respect to the horizontal. In particular, the pad 60 slopes upwardly from a second end 64 to a first end 62 thereof by an angle of between about 5 and 10 degrees from the horizontal (as best seen in FIGS. 2 and 3).

The weight carriage 28 comprises a rod 67, carriage frame 76, weight-supporting bars 78,80, and a user-engaging handle 88. The entire weight carriage 28 is rotatably connected to a sleeve 66 which is located on the front frame member 24 below the waist support 44.

The sleeve 66 extends along the center section 42 of the member 24 on the side facing the front 30 of the base 22 (i.e. the side of the member 24 facing away from the rear frame member 26). The sleeve 66 is about 25–26 inches long, thus extending beyond the first side 34 of the base 22 at a first end portion 68 thereof by about 2 inches. The sleeve 66 similarly extends beyond the second side 36 of the base 22 at a second end portion 70 thereof by about 2 inches. The sleeve 66 is thus wider than the center section 42 of the member 24 to which it is attached. The sleeve 66 is preferably constructed of metal, having a diameter of about 1.5 inches, with a wall thickness of about ⅛ inches.

The carriage frame 76 comprises first and second struts 72,74, and "L"-shaped legs 84,86 supporting the handle 88.

The first strut 72 extends from the first end portion 68 of the sleeve 66, and a second strut 74 extends from the second end portion 70 of the sleeve 66. At their opposite ends are located the weight-carrying bars 78,80 and the "L"-shaped legs 84,86 which support the handle 88.

Rotational means allow a user to move the carriage frame 76 from a first position in which the struts 72,74 extend downwardly from the sleeve 66 (as illustrated in FIG. 2), to a second position in which the struts 72,74 extend outwardly from the sleeve (as illustrated in FIG. 3).

Preferably, the rotational means comprises a rod 67 passing through the sleeve 66 and connecting the struts 72,74.

The rod 67 has an outer diameter slightly less than the inside diameter of the sleeve 66, and is made of metal. Each end of the rod is welded or connected by other attachment means to its corresponding strut 72,74.

The struts 72,74 are preferably made of metal, such as 1–2 inch square tubing. The struts 72,74 are each about 21 inches long.

A weight supporting bar 78,80 is located on the outside of each strut 72,74 at its end opposite the sleeve 66. Each bar 78,80 extends generally horizontally from its corresponding strut 72,74 outwardly of the first and second sides 34,36 of the base 22. The bars 78,80 are each about 9 inches long and 1.75 inches in diameter for supporting weight "plates" as well known in the art. The bars 78,80 are preferably welded to the respective strut 72,74. A spacer 81 (see FIG. 1) is located adjacent the end of each bar 78,80 at its connection to the strut 72,74 to prevent weights from damaging the struts. The spacers 81 are about 2 inches in diameter, 1 inch thick, and have central opening therein for location on the bar.

First and second "L"-shaped legs 84,86 extend from the struts 72,74. Each leg 84,86 extends inwardly about 5 inches, and then towards the rear 32 of the base 22 about 7–8 inches. The legs 84,86 are preferably constructed of 1.25 inch tubular metal having a wall thickness of about ⅛ inches.

A small pad 83 (see FIG. 1) is located on the inside of a portion of the leg 84,86 for engaging the front member 24. The pad 83 preferably comprises a rubbery or soft material attached to the leg for softening the impact of the carriage 28 if it engages the legs of the front member 24.

Grip means, in the form of the handle 88, extend between the legs 84,86. The handle 88 is thus about 15–16 inches long. Preferably, the handle 88 is a solid rod-shaped member made of steel. The handle 88 may be covered with foam or rubber for easier gripping by a user.

The carriage frame 76 includes adjustment means for manipulating the distance from the handle 88 to the struts 72,74. The adjustment means preferably comprises an extension 90,92 connected to each side of the handle 88 which extends into the legs 84,86. Each extension 90,92 has an outer dimension somewhat smaller than the inside dimension of its corresponding leg 84,86. At least two holes **94*a,b* are located in a top surface of the extension 90 for engagement by a downwardly extending pin 96 located on the corresponding leg 84. The pin 96** is biased downwardly towards the extension, and when correctly aligned, passes through a hole therein to lock it into place.

Locking means in the form of a threaded bolt 98 passes through the other leg 86 and engages the other extension 92 therein. The locking means eliminates any "play" or movement in the handle 88 because of the difference in size between the extensions and legs and the pin 96 and holes **94*a,b***.

A grip or handle 100,102 extends outwardly from each of the legs of the front frame member 24 just below the waist support 44. Each grip 100,102 is about 10 inches long and 1 inch in diameter and is made of metal or a similar strong material. The grips 100,102 are connected to the member 24 by welding, bolts or similar attachment means known in the art. Foam or rubber is located on the end of each grip 100,102 for improving a user's grip thereon.

Use of the machine 20 of the present invention will now be described in conjunction with FIGS. 1–3. A user, places one or more weights on each of the bars 78,80. The user then steps between the front and rear frame members 24,26, facing the front frame member 24.

The user bends over the waist support 44 located on the front frame member 24, with the majority of the torso above the waist extending outwardly beyond the waist support 44. As the user bends over, he grabs the grips 100,102 with his hands to support himself. He then pulls himself forwardly until his waist is located on and supported by the waist support 44. At this time, his legs leave the floor, and when straightened out, engage the leg stop 56 located on the rear frame member 26.

Once in this position, the user moves his hands down and grips the handle 88 extending between the struts 72,74. If the user's arms are particularly long, he can move the handle 88 rearwardly with the adjustment means. Alternatively, if his arms are short, he can move the handle 88 forwardly with the adjustment means. In either case, he loosens the bolt 98, and then pulls upwardly on the pin 96. He then moves the handle 88 in or out, until a new hole 94 is aligned with the pin 96. He then releases the pin 96, allowing it to engage the hole, and then tightens the bolt 98. This adjustment sequence can be accomplished before the user locates himself on the machine or after.

Once the handle 88 is properly positioned and the user is gripping it, the user is in the position illustrated in FIG. 2. In this position, the user's torso extends downwardly towards the base 22, the torso located at approximately a ninety-degree angle with respect to the waist and legs. Upward rotation of the legs is prevented because of their engagement with the leg stop 56 on the rear frame member 26.

The user exercises by straightening his torso until it is nearly aligned with his waist and legs, as illustrated in FIG. 3. As the user moves his torso upwardly, as effectuated by his back muscles, and especially his lower back muscles, he retains his grip on the handle 88 of the weight carriage 28, thus pulling it to the position illustrated in this Figure. The weight carriage 28 smoothly travels in an arc following the user's upward movement, as facilitated by the rotational means in the form of the rod 67 and sleeve 66 engagement. As illustrated, when the user straightens his torso with respect to his waist, the carriage 28 extends outwardly from the frame in a generally horizontal orientation.

Once the user has reached the position illustrated in FIG. 3, the user moves back to the position illustrated in FIG. 2 to complete the exercise. Multiple repetitions of this movement fully exercise the user's back.

Most advantageously, the fact that the user's arms extend downwardly and his hands grip the handle 88 reduces the possibility that the user can twist his body during the exercise and injure himself. Further, the user can select any amount of weight from none to many pounds for location on the bars 78,80 to obtain maximum results from his efforts.

Moreover, the movement of the carriage 28 in the arclike fashion means that the user's body movement from bent to straightened position is not effected by the fact the user is pulling the carriage 28. Thus, the user does not need to change the natural and smooth upward and downward movement of bending and straightening the back because he is adding the weights to the movement. This exercise also primarily utilizes the back as opposed to other muscles.

As a further aspect of the present invention, it is possible to eliminate the base 22 by securely mounting the first and second ends of each of the front and rear frame members to the floor or a similar stable structure. For example, the ends of the frame members may be located in concrete, or may include small flat plates which are directly attached to a floor with bolts, screws or the like.

Similarly, the rotational means which allow a user to move the carriage 28 between the first and second positions may comprise short pins which pass into the sleeve 66 from the end of each strut, hinges connecting the struts directly to the member 24, or similar structures known to those skilled in the art. Further, while the carriage 28 and sleeve 66 are preferably located on the member 24, they could be supported by an entirely separate structure.

The bars 78,80 which support the weights on the carriage 28 may have other forms as well. In particular, the bars 78,80 may comprise posts which extend simultaneously horizontally outward and slightly upwardly, so that the force of gravity tends to keep any weights located thereon from falling off. The bars 78,80 can also be located on the inside or front side of the struts, although this is not preferred since they then tend to interfere with the exercise.

Moreover, the resistive force or resistance means need not even comprise free weights located on the carriage. For example, the carriage may be connected via one or more cables to a remote weight stack. Movement of the carriage would require movement of one or more weights on the stack. Other adjustable resistive exercise forces for use in combination with the carriage of the present invention are useful as well, such as springs or the like.

The waist support 44 and leg stop 56 may be selectively tiltable about the frame. This allows exercisers of different sizes to adjust the position of the support 44 and stop 56 to meet their individual needs.

The machine may also include means for moving the front and rear frame members 24,26 with respect to one another. In this fashion, a user may adjust the distance between these two member to accommodate his shorter or longer legs and torso.

Stop means, in the form of a ratchet or other carriage-engaging member may be used to prevent full downward rotation of the carriage into the position illustrated in FIG. 2. For example, a position adjustable washer may be located on one of the struts for engagement with a pin extending from the sleeve.

Figure 4:
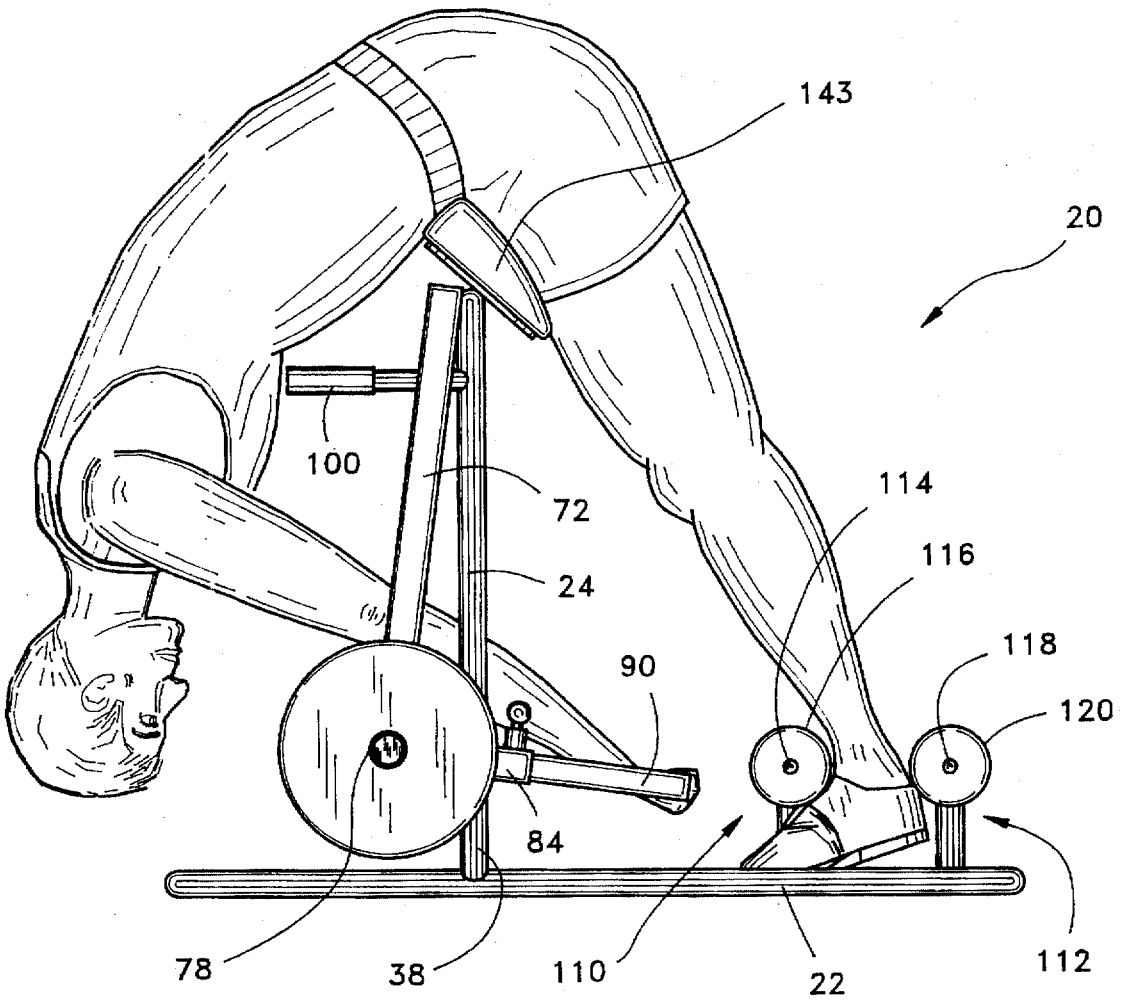
FIG. 4 is a side view of a second embodiment of the device of the present invention.

As a further aspect of the present invention, and as illustrated in FIG. 4, the leg stop means comprises first and second foot engaging members 110,112 instead of the member 26 described above.

In some instances, for example where an exerciser has been injured and is rehabilitating his back, it is desirable that the carriage 28 not extend down below the waist support 44 as illustrated in FIG. 2. In such a position, an exerciser is required to fully extend his back in order to reach the handle 88, something which can not be accomplished by those having an injured back.

The first foot engaging member 110 is located rearwardly of the first member 24 about 10–14 inches, and includes an elongate cylindrical pad 116 mounted on a bar 114. The bar 116 extends upwardly from the base 22 about 4–7 inches, and between the sides 34,36 thereof. This member 110 engages the top fronts of the exerciser's feet.

The second foot engaging member 112 is located behind the first 110 by about 4–10 inches, and includes an elongate cylindrical pad 120 mounted on a bar 118. The bar 118 extends upwardly from the base 22 about 6–9 inches, and between the sides 34,36 thereof. This member 112 engages the back of the user's feet at the heels.

In this embodiment, the pad 143 of the waist support is tilted upwardly from rear to front at an angle of about 40–75 degrees to accommodate the exerciser's sharply downwardly extending legs.

Use of this embodiment of the invention is nearly identical to that described above, except that upward movement of the user's legs is prevented by engagement with the first and second foot engaging members 110,112. In particular, the front of the user's feet engages the front pad 114, and the heel of the user's feet engage the rear pad 118, binding his feet into a fixed position during exercise.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. An exercise device comprising:

a frame having a front end, a rear end and a support surface contacting means;

a generally horizontally extending waist support member connected to said frame near the front end thereof and located above said support surface contacting means, said waist support member adapted to support an exerciser's body above said support surface contacting means when a front said of an exerciser's body at a waist area engages said waist support;

a generally horizontally extending leg stop member connected to said frame near the rear end thereof and located above said support surface contacting means, said leg stop member adapted to prevent upward movement of an exerciser's legs when the exerciser is in a generally horizontal position with his waist engaging said waist support member;

a carriage movably mounted to said frame and movable by an exerciser between a rest position and an extended position wherein said carriage is downwardly depending from said waist support member in said rest position and is outwardly depending in said extended position;

a resistance means for opposing movement of said carriage from said rest position to said extended position;

a hand grip means located on said carriage for enabling an exerciser to hold said carriage while exercising, said hand grip means located below said waist support member and rearward of said front end of said frame when said carriage is in said rest position.

2. An exercise device comprising:

a frame having a front end, a rear end and a support surface contacting portion;

a generally horizontal extending waist support member connected to said frame near the front end thereof and located above said support surface contacting portion of said frame, said waist support member adapted to support an exerciser's body above said support surface contacting portion of said frame when a front side of an exerciser's body at a waist area engages said waist support;

a generally horizontally extending leg stop connected to said frame and located rearwardly of said front end and located above said support surface contacting portion of said frame, whereby said leg stop prevents upward movement of an exerciser's legs when the exerciser is in a generally horizontal position with his waist engaging said waist support member;

a carriage movably mounted to the frame and moveable by an exerciser between a rest position and an extended position, said carriage having hand grip means located thereon for enabling an exerciser to hold the carriage while exercising, wherein said carriage depends downwardly below said waist support member in said rest position, with said hand grip means positioned rearwardly of said waist support member; and resistance means for opposing movement of said carriage from said rest position to said extended position.

3. An exercise device comprising:

a frame having a front end, a rear end and a support surface contacting portion;

a generally horizontal extending waist support member connected to said frame near the front end thereof and located above said support surface contacting portion of said frame, said waist support member adapted to support an exerciser's body above said support surface contacting portion of said frame when a front side of an exereiser's body at a waist area engages said waist support;

a generally horizontally extending leg stop connected to said frame and located rearwardly of said front end and located above said support surface contacting portion of said frame, whereby said leg stop prevents upward movement of an exereiser's legs when the exerciser is in a generally horizontal position with his waist engaging said waist support member;

a carriage movably mounted to the frame and moveable by an exerciser between a rest position and an extended position wherein said carriage includes first and second struts extending downwardly from a rod rotatably positioned in a sleeve connected to said frame;

resistance means for opposing movement of said carriage from said rest position to said extended position; and a hand grip means located on said carriage for enabling an exerciser to hold the carriage while exercising.

4. The device of claim 3, further including a handle extending between said struts.

5. The device of claim 4, further including means for adjusting the location of said handle on said carriage.

6. A device for use by an exerciser in exercising his lower back muscles, comprising:

an upwardly extending user supporting member;

a waist support member located on said upwardly extending user-supporting member, said waist support member including a generally horizontal surface adapted to support a user at a waist portion thereof when an exerciser is located on said device;

a leg stop located on a second upwardly extending member, said leg stop including a generally horizontal surface for engaging an exerciser's legs; and a carriage movably connected to said upwardly extending user supporting member, said carriage comprising a rod extending through a tube connected to a front end of said waist support, said rod rotatable within said tube, a first strut extending from a first end of said rod and a second strut extending from a second end of said rod, a first arm extending from said first strut inwardly toward said upwardly extending user supporting member, a second arm extending from said second strut inwardly toward said upwardly extending user supporting member, and a handle, said handle connected to said arms, said carriage moveable between a first position in which it extends downwardly from said member to a second position in which it extends outwardly therefrom; and resistance means connected to said carriage for opposing movement of said carriage from said first position to said second position.

7. The device of claim 6, wherein said upwardly extending user supporting member comprises an inverted "U"-shaped member having a platform on a top surface thereof.

8. The device of claim 6, wherein said upwardly extending user supporting member is connected to a ground-contacting base.

9. The device of claim 8, further including a leg stop positioned above said base and connected thereto.

10. The device of claim 6, wherein said carriage includes at least one weight-supporting bar.

11. The device of claim 6, wherein said arms are tubular and said handle includes a first portion for location within said first arm and a second portion for location within said second arm, whereby the relative position of the handle with respect to each arm may be adjusted.

12. The device of claim 11, wherein said first and second arms and said first and second portions of said handle include at least one bore therein for acceptance of a pin.

* * * * *

UNITED STATES PATENT AND TRADEMARK OFFICE

CERTIFICATE OF CORRECTION

PATENT NO. : 5,669,860
DATED : September 23, 1997
INVENTOR(S) : Gilbert Reyes

It is certified that error appears in the above-identified patent and that said Letters Patent is hereby corrected as shown below:

Column 8,
Line 23, please change “said” to -- side --.

Column 9,
Line 17, please change “exereiser’s” to -- exerciser’s --.

Signed and Sealed this

Twenty-fifth Day of February, 2003

JAMES E. ROGAN
*Director of the United States Patent and Trademark Office*